US006742683B1

(12) United States Patent
Phan

(10) Patent No.: US 6,742,683 B1
(45) Date of Patent: Jun. 1, 2004

(54) WASHING, DRYING, AND STORAGE DEVICE FOR BRASSIERES AND BIKINI TOPS

(76) Inventor: Kieu Thi-Bich Phan, 916 W. 23 St., Apt. No. 210, Austin, TX (US) 78705

( * ) Notice: Subject to any disclaimer, the term of this patent is extended or adjusted under 35 U.S.C. 154(b) by 0 days.

(21) Appl. No.: 10/191,538

(22) Filed: Jul. 9, 2002

(51) Int. Cl.[7] ..... D06C 15/00
(52) U.S. Cl. ..... 223/84
(58) Field of Search ..... 223/84

(56) References Cited

U.S. PATENT DOCUMENTS

| | | | | |
|---|---|---|---|---|
| 916,327 | A | 3/1909 | Kingsbury | |
| 981,805 | A | 1/1911 | Smith | |
| 2,089,266 | A | 8/1937 | Kalvin | |
| 2,676,735 | A | 4/1954 | Hellman | |
| 2,730,275 | A | 1/1956 | Flores | |
| 2,755,004 | A | 7/1956 | Schumacher | |
| 2,786,346 | A | 3/1957 | Brandenburg | |
| 2,786,347 | A | 3/1957 | Whitlock | |
| 2,951,621 | A | 9/1960 | Cheney | |
| 3,085,723 | A | 4/1963 | Vanderburg | |
| 3,769,819 | A | 11/1973 | Contreras | |
| 4,714,353 | A | 12/1987 | Leaphart | |
| 5,172,837 | A | 12/1992 | Finney, Jr. | |
| 5,211,191 | A | 5/1993 | Brown | |
| 5,320,429 | A | 6/1994 | Toyosawa | |
| 5,556,013 | A * | 9/1996 | Mayer | 223/84 |
| 5,746,514 | A | 5/1998 | Orensten | |
| 5,829,083 | A | 11/1998 | Sutton | |
| 5,971,236 | A | 10/1999 | DesForges | |
| 6,234,368 | B1 | 5/2001 | DesForges | |

FOREIGN PATENT DOCUMENTS

| | | |
|---|---|---|
| GB | 2238323 A | 5/1991 |
| GB | 2291654 A | 1/1996 |
| JP | 6-312084 | 11/1994 |
| JP | 8-332123 | 12/1996 |
| JP | 9-220394 | 8/1997 |
| JP | 10-192597 | 7/1998 |
| JP | 2000-116981 | 4/2000 |
| JP | 2000-167287 | 6/2000 |
| JP | 2000-325691 | 11/2000 |
| JP | 2001-137593 | 5/2001 |

* cited by examiner

*Primary Examiner*—John J. Calvert
*Assistant Examiner*—James G Smith

(57) ABSTRACT

A device for washing, drying, and storing brassieres and bikini tops and the like comprises an outer shell having two halves that have a plurality of holes. A foraminous inner form, which also contains a plurality of holes, has an exterior surface shaped like the contours of a padded bra cup breast side. The bra cups' breast side rests against the inner form's exterior surfaces to prevent it and the bra's underwires from losing their natural curvature. The inner form is hollow and provides space for the containment of a bra's shoulder and back straps. The inner form is secured to the outer shell's two halves by a first hinge, which allows the inner form to swing from first half to second half and vice versa, and also allows first half and second half to open and close like a clamshell. A second hinge is located between the first hinge and the inner form to allow the inner form to swing away from the outer shell's two halves and back to its original position for easy placement and removal of bra(s) inside in the device. A latching mechanism secures the device in a closed and locked or latched position and is located between the exterior and interior surfaces of the outer shell's two halves. The protruding rim on one half of the outer shell nestles within the receiving rim on the other half to prevent lateral movement of the two halves.

20 Claims, 5 Drawing Sheets

WASHING, DRYING, AND STORAGE DEVICE FOR BRASSIERES AND BIKINI TOPS

CROSS-REFERENCE TO RELATED APPLICATIONS

Not applicable.

FEDERALLY SPONSORED RESEARCH

Not applicable.

SEQUENCE LISTING OR PROGRAM

Not applicable.

BACKGROUND OF THE INVENTION

1. Field

This invention relates to clothes washing, particular to a washing, drying, and storage device for brassieres and bikini tops.

2. Prior Art

Brassieres are commonly made with two cups, two shoulder straps, two back straps, a latching mechanism (hooks and eyelets), optional padding (soft foam, air, water, gel, or silicone), and, optionally, two underwires. Padding can come as removable inserts or as an integral part of the bra. Some bras comprise extremely delicate fabric, such as lace, satin, silk, mesh, high-tech microfiber, stretch, and sheer fabric.

The underwires, when used in the cups, often become misshapen during washing and drying. Over time, the underwires frequently tear through the bra's fabric. This can result in injury to the breast or bra, and can also damage other clothing and the washing machine drum.

The latching mechanism, located either on the two back straps or on the front in between the cups at the intercup bridge, typically has several hooks and eyelets or a plastic snap closure. In the washing machine and/or dryer the hooks frequently snag onto the bra itself, zippers, buttonholes, sweaters, and delicate fabrics, as well as becoming misshapen. A bra can also easily become tangled with other clothing and in crevices within the washer and dryer, causing further deformities to the cups, padding, underwires, fabric, and straps. Repeated machine washing and drying can substantially diminish the elasticity of bras. The padding, especially if made of thick and soft foam, often becomes indented and bunched. If made of air, water, gel, or silicone, it can becomes punctured and leak. Such deformities are visible, even through a T-shirt, and are especially noticeable when tight fitting garments are worn. These problems are well understood by women who wear padded or non-padded bras.

Consequently, in an attempt to protect the bra's original shape, some users have tried to wash bras in a dishwasher. To do so, the bra must be fastened to the dishwasher to prevent it from shifting and becoming damaged by the dishwasher's pointed rack rods and rotating spray arm. Another way to wash bras is to place it within a mesh washing bag, which is then placed in a washing machine or dishwasher. However, because of its soft material construction, the bag still does not adequately prevent the bra from being damaged—such as losing its original shape, collapsing inward and against the cups' curved shape, and becoming tangled with other bras within the same bag. In addition, padded bras (especially those using air, water, gel, or silicone) can be easily punctured, thus causing leakage to the bra cups. The bra's hooks can also come loose and snag on other bras placed within the same bag. The time and money needed to replace a damaged bra can also be substantial.

Given all these inconveniences, many women have chosen to wash their bras by hand. However, hand washing is very time-consuming and impractical. It can also cause back, hand, and wrist pain. Most bras that are hand washed have to be air-dried, which causes huge water deposits where they are hung and thus slippery surfaces and more unnecessary cleanup.

One attempt to address the aforementioned problems has been made by DesForges with a garment protector as shown in U.S. Pat. No. 5,971,236 (Oct. 26, 1999). It comprises two separate inner and outer shells that snap together in a concavo-convex fashion with the bra secured between the shells. The user must place the right bra cup on top of the left bra cup before it can be inserted into DesForges's device. This folding process disfigures the bra cups' curvature, especially when the bra is padded, even before it is washed and dried. The more padded the cups, the more susceptible they are to disfigurement, especially when folded in this fashion. The bra's straps, along with its hooks, are left dangling outside the device, which can then snag onto clothing, zippers, buttonholes, as well as in the washer and dryer's crevices. Although DesForges claims that bra straps may be held within the device, the gaps throughout the device's shell are larger than the straps, thus leaving space for the straps to escape and become tangled with the previously mentioned items. A final problem is that its locking mechanism consists of three pins, which easily can slide out of its engaging slot.

DesForges shows another garment protector in U.S. Pat. No. 6,234,368 (May 22, 2001) which is basically the same as that of his '236 patent, but adds a circular cover that fits over the inner form to hold an extra clothing article. All of the previous devices flaws are still present in this one. However, another problem arises—that is, the cover is very unstable. Moreover, it isn't clear how this cover can be secured in place; it will easily come loose during machine washing and drying.

Mayer shows a garment protector in U.S. Pat. No. 5,556,013 (Sep. 17, 1996). It comprises two domed-shaped baskets with two hinged springs. The bra cups are sandwiched between the two baskets and springs. The problem with this design is that the springs place excessive pressure on the bra cups, thereby damaging their fragile fabric and padding. Some bras are made of fabric, which is too delicate to withstand the spring's pressure. Mayer's device has three locking mechanisms, four hinges, and two spring-like components. These components are confusing and make using the device difficult. Although Mayer claims that the device's baskets prevent the bra's straps from tangling with other clothing, the patent does not describe how this would be accomplished.

Sutton shows a garment protector in U.S. Pat. No. 5,829,083 (Nov. 3, 1998) that includes a pair of hemispherical sections that form two balls, with the smaller ball nested within the larger ball. The bra is held by the inner ball, which is then placed within the outer ball. The problem with this design is that not all bra cups are perfectly spherical, especially padded ones. For example, almost all padded bras are thicker on the bottom where the underwires lie, and then gradually thin out towards the top. This graduated foam padding creates a more natural fit for the wearer than an evenly padded bra and a more pleasing appearance to the upper part of the breasts that are exposed when wearing certain styles of blouses, etc. Because of its irregular contours, the inner part of a padded bra, especially a thickly padded one, will not rest properly in Sutton's device. Moreover, the device will not securely hold the bra. The gaps are too big so that bra straps and hooks can easily escape. Both hinges and locking mechanisms are unstable, as they protrude from the device, and can easily hit the washer and dryer, and eventually become damaged, thus making it unfit for further use. Also, the pins of the hinge mechanism are removable, so a user can easily misplace them, also rendering the device useless. Sutton's device requires some trial-and-error to use, and therefore is not user-friendly. For example, it isn't clear if the user must open the device by pressing the thumb lever only, or must also remove the rods or pins. Overall, this design is big and unwieldy, and thus occupies a large volume in a washer or dryer.

Another garment protector is shown in UK published patent application 2,238,323 A to Beyer (May 29, 1991). It uses a stiff cage-like container with tiny holes in the walls. This device has a lower container portion and an upper lid portion. However, this design is also flawed. Although the rigid container may protect the bras from the outside environment, it does not protect the bra's internal structure. For example, semi-padded and thickly padded bras are made from various materials (e.g., soft foam, gel, water, air or silicone) that often become damaged with indentations, deformations, and leakage. The bra's padding and natural curvature can collapse inward, and against their original curved shape, and the hooks can come loose and snag on the bra placed within the same device. In addition, the locking mechanism consists of two external clasps with holes that snap into its receiving studs. This mechanism appears unstable and can break from constant impact with the washer and dryer through repeated use.

Another garment protector is shown in UK published patent application 2,291,654 A to McArdle (Jan. 31, 1996). It uses a container resembling a flattened jar or disk. The bra is placed inside the container and is secured by screwing on the lid. There are several problems with this design. First, the holes are too small and too few, thus preventing the bra from being properly cleaned and dried. Furthermore, there is nothing to prevent the bra cups from becoming deformed, especially padded ones.

In sum, all prior-art protectors of which I am aware have one or more of the following disadvantages and defects:

They require users to fold the bra cup portion on top of one another before it can be inserted into the device. This causes the cup portions of the bra to lose their curvature and become flattened, resulting in improper fitting of the bra cups around the wearer's breasts.

The gaps throughout each device's shell are much larger than the bra's straps, and thus leave plenty of space for the straps to escape from the device. Thus, the bra's back and shoulder strap portions can become tangled with other clothing articles, causing loss of elasticity and distortions to the bra cups and straps. Moreover, uncontained hooks on the bra strap can become caught in buttonholes, sweaters, zippers, the bra itself, as well as other clothing articles.

These devices' designs can damage a bra's delicate fabric (e.g., lace, satin, silk, mesh, high-tech microfiber, and stretch fabric) by putting excessive pressure on it. This causes the bra's fabric to run, snag, and pucker, creating imperfections that are visible through an outer layer of clothing.

These devices do not prevent the soft foam padding from indenting and bunching, causing visible deformity to the bra. These imperfections are especially visible when body-hugging garments are worm. These deformities are especially noticeable to women who wear padded bras.

These devices offer no protection for bra padding comprised of air, water, gel, and silicone, which can become punctured and leak, thereby ruining the bra cups and rendering the bra useless.

The hinges and locking mechanisms of these devices are unstable as they protrude unprotected from the device, making them vulnerable to damage.

Objects and Advantages

Accordingly, several objects and advantages of my bra device are:

(a) to provide an improved device for protecting bras during washing, drying, and storage.

(b) to provide such a device that can be used to wash bras of various designs—including non-padded, semi-padded and heavily padded bras—regardless of whether the padding is made of soft foam, air, water, gel, or silicone.

(c) to provide such a device that can allow water, detergent and air to penetrate, yet contain the bra's straps to prevent them and their hooks from escaping.

(d) to provide such a device that prevents bra hooks from puncturing, hooking onto, and tearing the bra itself as well as other clothing articles.

(e) to provide such a device that has a reliable and user-friendly latching mechanism and which is not susceptible to damage when properly used.

(f) to provide such a device that can shield both the contained bra and the latching mechanism during washing, drying, and storage.

(g) to provide such a device that protects the bra's delicate fabric, thus preventing it from running, snagging, and puckering.

(h) to provide such a device that prevents a bra from being battered, thus preventing unsightly contours due to the bunching of the padding medium.

(i) to provide such a device that can preserve the curvature of the bra's cups and underwires during washing, drying, and storage.

(j) to provide such a device that can contain a bra and all its components for machine washing, drying, and storage.

(k) to provide such a washing, drying and storage device that can easily fit into a washing machine and dryer.

Additional Objects and Advantages are (l) to provide an inexpensive, convenient, reliable, lightweight, and sturdy device that can be easily used when washing, drying, and storing one to three bra;

(m) to provide such a device that prevents the bra cups from tangling within the device and from becoming misshapen once the device is closed and locked, and when properly used.

(n) to provide such a device that can be used to wash, dry, and store not only bras and bikini tops, but also removable bra straps, demi-pads, pushup pads, shoulder pads, hosiery, panties and scarves.

(o) to provide a bra protecting device that can withstand hot water from a washing machine and hot air from a dryer.

(p) to provide such a device with no sharp edges, which prevents it from damaging other clothing articles in the washer or dryer while in use.

(q) to provide such a device that can prevent lateral movement of the two outer shell halves during washing, drying, and storage.

(r) to provide such a device that can accommodate at least one thickly padded bra, two semi-padded, or three non-padded bras.

(s) to provide such a device which will properly protect a bra so that it will last nine or ten times as long as one that is not protected during washing, drying, and storage, thus reducing the cost of bras and the impact of manufacturing on the environment.

Further objects and advantages will become apparent from consideration of the drawings and ensuing description.

SUMMARY

In accordance with the present invention, a washing, drying, and storage device for brassieres and bikini tops comprises an outer shell, which can be split into two halves, an inner form, at least one hinge, and one latching mechanism. The inner form and outer shell's two halves have holes that are large enough for water, detergent, and air to reach the bra inside, yet are smaller than the bra's shoulder straps. This prevents them from escaping and snagging on other clothing including the bra itself.

DRAWING FIGURES

REFERENCE NUMERALS IN DRAWINGS

| | | | |
|---|---|---|---|
| 20 | holes | 26A | breast side |
| 26B | breast side | 28A | front side |
| 28B | front side | 30 | intercup bridge |
| 32 | back strap | 34A | bra cup |
| 34B | bra cup | 36 | shoulder strap |
| 48 | underwire | 50 | first hinge |
| 52 | inner form | 54A | exterior surface |
| 54B | exterior surface | 56 | hollow compartment |
| 59 | ridge opening | 60 | receptacle |
| 62 | ridge | 64 | tongue |
| 66 | first half | 68A | exterior surface |
| 68B | exterior surface | 70 | finger opening |
| 72A | interior surface | 72B | interior surface |
| 74A | raised exterior surface | 74B | raised exterior surface |
| 76 | gap | 78 | protruding rim |
| 80 | receiving groove | 82 | second half |
| 84 | second hinge | 100 | holes |
| 104 | ridge opening | 106 | receptacle |
| 108 | separator | 110 | teeth |
| 112 | first half | 114 | finger openings |
| 116A | exterior surface | 116B | exterior surface |
| 118A | interior surface | 118B | interior surface |
| 120 | second half | 124 | holes |
| 126 | first half | 127 | second half |
| 128 | hinge | 130 | receptacle |
| 132 | ridge | 134 | tongue |

DETAILED DESCRIPTION

Preferred Embodiment

Figure 1:
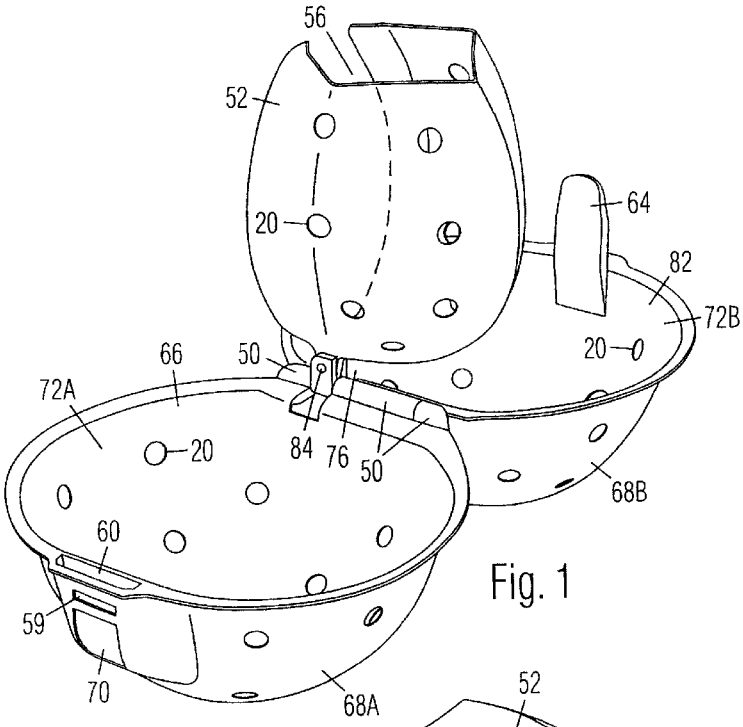
FIG. 1 shows a bra washing, drying, and storage device according to my invention in an opened position with an inner form in the center.

FIG. 1—Overall Device

FIG. 1 shows my bra protector in an open or starting position. The device preferably is made out of polypropylene which is heat graded to protect it from heat damage. The protector has a first half 66 and a second half 82, an inner form 52, a first hinge 50, a second hinge 84, and a latching mechanism comprising a tongue 64 with ridge 62 (not shown) and a receptacle 60 with ridge opening 59 and finger opening 70.

First half 66, second half 82, and inner form 52 are foraminous, i.e, they have numerous circular holes 20. These holes allow water, detergent, and air to freely penetrate to a bra inside (not shown) for thorough cleaning, drying, and storage. (The number of holes in FIG. 1 has been decreased for clarity purposes.) Each protector will have approximately 160 to 230 holes, depending upon the size of the device (the size depends upon the bra's cup size). The numerous holes 20 allow detergent, water, and air to freely and thoroughly penetrate and flow between the bras when two semi-padded or three non-padded bras are simultaneously washed in the device. The diameter of each hole is preferably one cm, but can be smaller, and should not be any smaller than 0.5 cm. One-cm holes are smaller than the bra's shoulder straps 36, which will prevent the straps from falling out of holes 20. This will also prevent bra's back straps 32 and shoulder straps 36 from losing elasticity and the hooks on the bra's back strap 32 from catching onto other clothing articles, zippers, buttonholes, the washer and dryer's crevices, as well as the bra itself. Preferably first and second halves 66 and 82 have a diameter of 12 to 16 cm with each half having 60 to 80 holes 20 (depending upon the device's size, which is determined by the bra's cup size). Inner form 52 preferably has 40 to 70 holes.

First hinge 50 connects first half 66 and second half 82 to inner form 52. One knuckle of first hinge 50 extends out from first hinge 50 and contains the pin of second hinge 84 which is perpendicular to the pin of first hinge 50. First hinge 50 allows both inner form 52 to swing from first half 66 to second half 82, and vice versa, and also allows first half 66 and second half 82 to open and close like a clam shell.

Inner form 52 is pivotably attached to second hinge 84 so that inner form 52 can pivot around the pin of second hinge 84 as well as pivot in a perpendicular fashion around second hinge 84. Specifically, one knuckle of first hinge 50 extends out from first hinge 50 as two plates which contain their own second hinge 84 whose pin is perpendicular to the pin of first hinge 50. Second hinge 84 is located between inner form 52 and first hinge 50, and allows the user to move inner form 52 away from and back to its original position between first half 66 and second half 82.

The main purpose of first and second halves 66 and 82 is to protect the bra from damage caused by the washer, dryer, and other clothing articles. A secondary purpose is to protect the latching mechanism.

First half 66 has an interior surface 72A and exterior surface 68A while second half 82 has an interior surface 72B and exterior surface 68B.

Tongue 64 is located on second half 82, while finger opening 70, receptacle 60, and ridge opening 59 are located on first half 66. Tongue 64 is located between exterior surface 68B and interior surface 72B on second half 82. Receptacle 60 is located between interior surface 72A and exterior surface 68A of first half 66. First half 66 and second half 82 shield tongue 64 and receptacle 60 from normal wear and tear, and ensure that the device remains closed during washing, drying, and storage.

A gap 76 is formed below second hinge 84 by the space between first hinge 50 and inner form 52. Gap 76 preferably measures 1.5 cm to accommodate up to three bra intercup bridges 30, depending upon the thickness of the bra's cups 34A and 34B.

Figure 2:
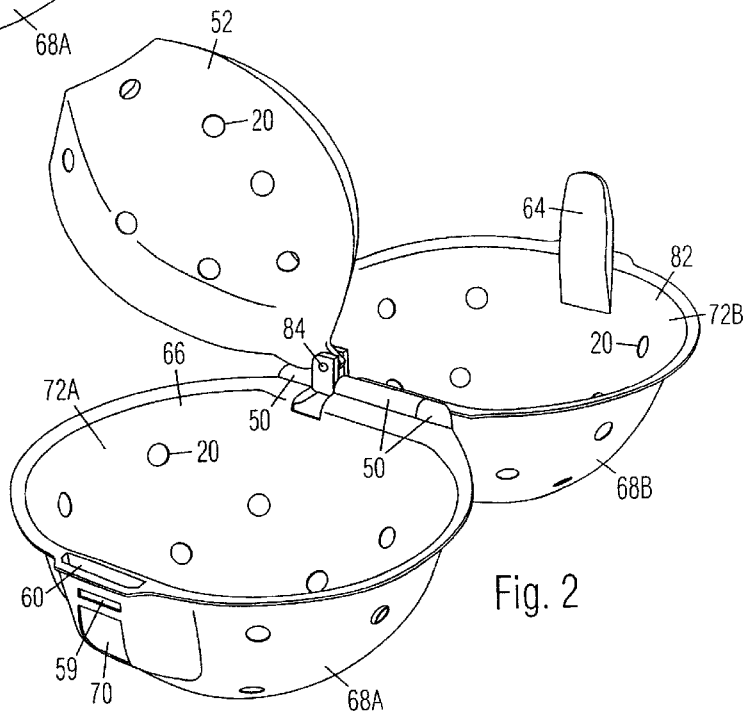
FIG. 2 shows the device in its opened position with the inner form flipped outward and away from an outer shell's two halves.

FIG. 2—Overall Device with Inner Form Swung Out

Inner form 52 can be swung out from first half 66 and second half 82 as shown in FIG. 2. When inner form 52 is swung out, one to three bras (not shown) can be stacked inside. Holes 20 can be seen on first half 66 and second half 82 and inner form 52. (The number of holes in FIG. 2 has been decreased for clarity purposes.) Second hinge 84 facilitates the placement and removal of a bra or bras inside the device, by allowing inner form 52 to swing away from first half 66 and second half 82 and back to its original resting position within the protector. It also prevents inner form 52 from knocking against first half 66 and second half 82, during washing, drying, and storage.

Figure 3:
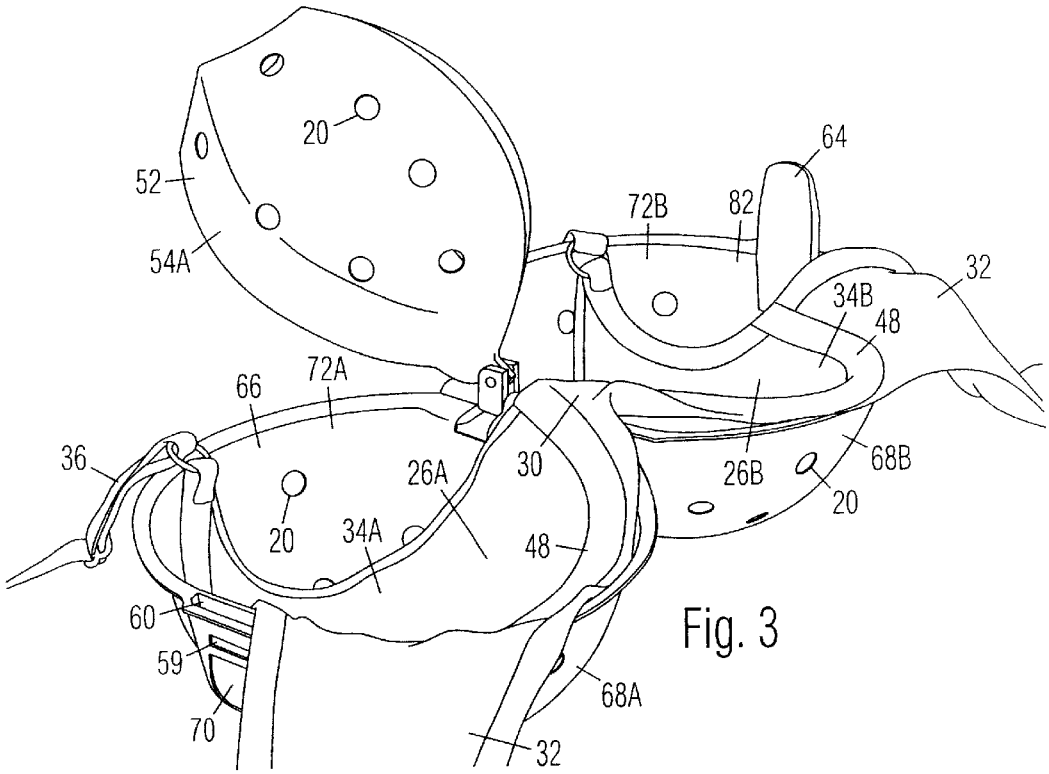
FIG. 3 shows the device in its opened position with the inner form flipped outward from the outer shell's two halves and a bra placed inside the two outer shell halves.

FIG. 3—Overall Device with Inner Form Swung Out and One Bra Placed Inside

In FIG. 3, inner form 52 is swung out from the device, allowing the bra cup's front side 28A to be placed into interior surface 72A and bra cup's front side 28B to be placed into interior surface 72B. Front side 28A should rest against interior surface 72A while front side 28B should rest against interior surface 72B. Front sides 28A and 28B are the portions of the cups that face away from the breasts of the woman wearing a bra. For clarity purposes, both back strap 32 and shoulder strap 36 are shown outside of the hollow compartment 56 of inner form 52. A bra intercup bridge 30 rests in gap 76. Inner form 52 will cradle breast side 26A. The other cup breast side 26B is not shown as it is nestled by inner form 52. (The number of holes 20 in FIG. 3 has been decreased for clarity purposes.)

Figure 4:
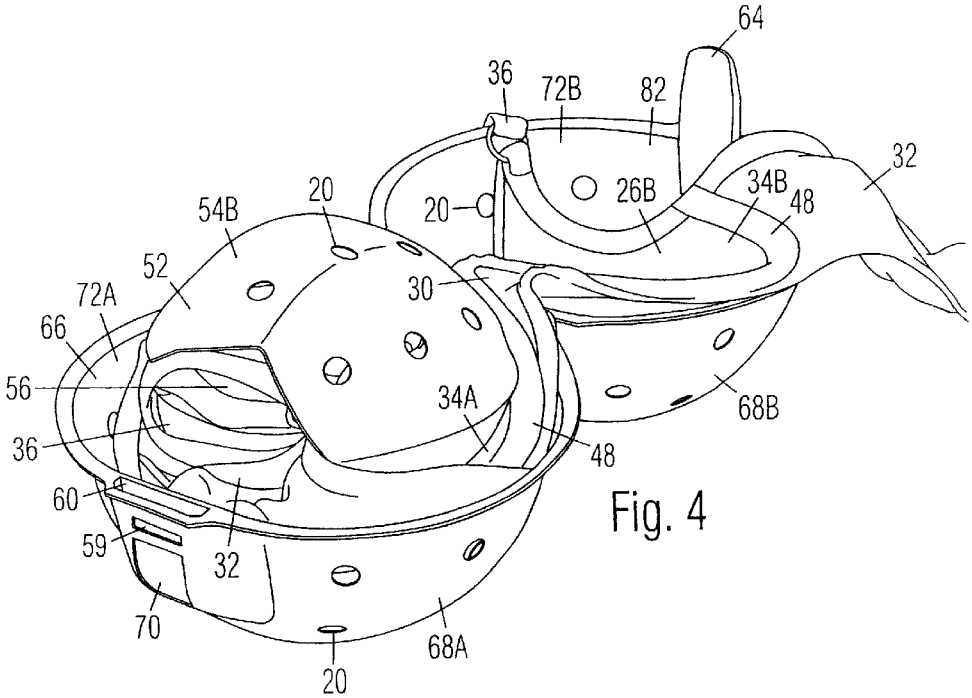
FIG. 4 shows the device in its opened position with a bra placed inside the two outer shell halves while the inner form is nestled inside the left bra cup's breast side.

FIG. 4—Overall Device with Inner Form Nestled Inside Left Bra Cup

FIG. 4 shows a bra placed inside the device and inner form 52 containing one shoulder strap 36 and one back strap 32. (The number of holes 20 in FIG. 4 has been decreased for clarity purposes.) A bra is positioned inside first half 66 and second half 82. Inner form 52 is nestled inside cup breast side 26A. Given that the device is in its open position, cup breast side 26B is currently not pictured nestled around inner form 52, but resting inside interior surface 72B. Exterior surfaces 68A and 68B of the shell's halves face the drum of the washer or dryer. Shoulder strap 36 and back strap 32 are tucked into hollow compartment 56. (The other shoulder strap 36 and back strap 32 are not shown as they are contained in the hollow compartment 56).

Inner form 52 preserves the curvature of underwires 48 and bra cups 34A and 34B since it has the same contour as the cup breast sides 26A and 26B. Hollow compartment 56 can also house other delicate accessories, such as removable bra straps, demi-pads, pushup pads, shoulder pads, hosiery, panties, and scarves. The protector has sufficient space to accommodate up to one thickly-padded bra as shown, or two stacked semi-padded bras, or three stacked non-padded bras (not shown). When more than one bra is placed inside the protector, they are stacked so that the front sides of the cups of the second bra faces the breast sides of the cups of the first bra, etc.

Figure 5:
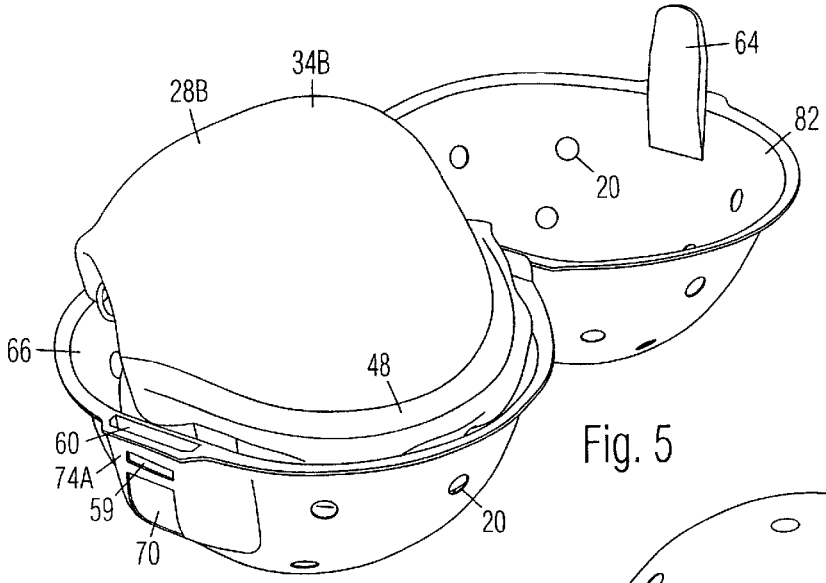
FIG. 5 shows the device in its opened position with a bra placed inside and the inner form nestled inside both the left and right bra cup's breast side.

FIG. 5—Overall Device with Right Bra Cup Folded Over Left Bra Cup

FIG. 5 illustrates inner form 52 nestled inside cup breast sides 26A and 26B. (The number of holes 20 in FIG. 5 has been decreased for clarity purposes.) Shoulder straps 36 and back straps 32 are not shown, but are tucked into hollow compartment 56 of inner form 52. To close the protector, first and second halves 66 and 82 are closed toward each other, like a clam shell. Tongue 64 is inserted into and held in place by receptacle 60. A clicking sound will be heard when the device is correctly closed. To open the protector, the user presses a finger inward into finger opening 70 and releases recessed tongue 64 and ridge 62 (not shown) from finger opening 70 and ridge opening 59 on receptacle 60.

Figure 6:
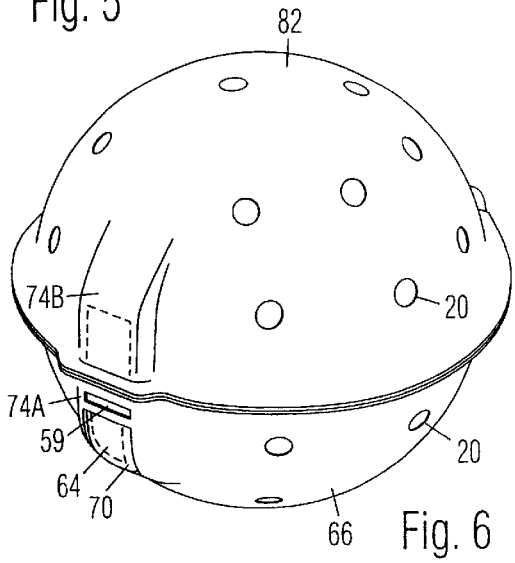
FIG. 6 shows the device in its closed position.

FIG. 6—Overall Device in Closed Position

FIG. 6 shows the device in its locked and closed position. (The number of holes 20 in FIG. 6 has been decreased for clarity purposes.) Tongue 64, shown in outline form located inside finger opening 70, is shielded by receptacle 60 and raised exterior surfaces 74A and 74B, which protect recessed tongue 64 from damage. This also prevents the latching mechanism from accidentally opening during normal use. To open the latching mechanism, the user must reach into finger opening 70 to press recessed tongue 64 downward and then pull first and second halves 66 and 82 away from each other.

Figure 7:
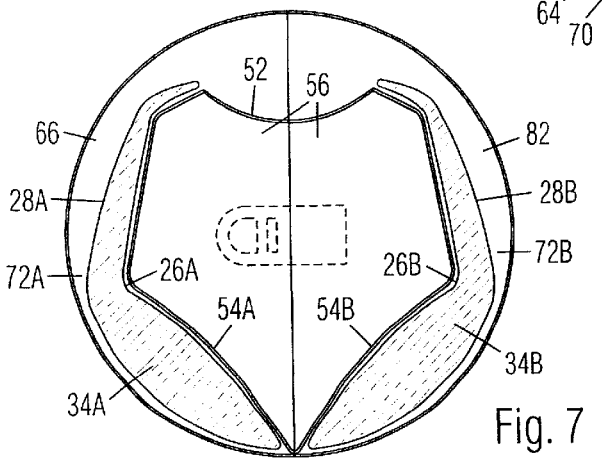
FIG. 7 shows the space between the inner form and outer shell where a bra's cups lie.

FIG. 7—Cross Section

FIG. 7 illustrates a cross section of the device in its locked position with inner form 52 and a padded bra (shaded portion of figure) inside the protector. The device is seen through the latching mechanism and illustrates how both bra cups 34A and 34B of a thickly padded bra is cradled by first half 66 and second half 82, with inner form 52 separating bra cups 34A and 34B. Hollow compartment 56 of inner form 52 is located where both bra's back straps 32 and shoulder straps 36 are contained (not shown).

Exterior surface 54A of inner form 52 faces bra cup breast side 26A while exterior surface 54B faces bra cup breast side 26B. Interior surfaces 72A and 72B accommodate the convex shape of bra cup front sides 28A and 28B, while exterior surfaces 54A and 54B of inner form 52 accommodate the concave shape of bra cup breast sides 26A and 26B.

The space within the device between exterior surfaces 54A and 54B of inner form 52, and interior surfaces 72A and 72B of first and second halves 66 and 82 respectively, allow the snug placement of not only thickly padded, but also semi-padded and non-padded bras.

Figure 8:
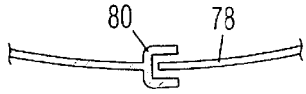
FIG. 8 shows the device's protruding rim on one half of the device nestled within the receiving groove on the other half.

FIG. 8—Receiving Groove and Protruding Rims

FIG. 8 shows receiving groove 80 nestling protruding rim 78. Protruding rim 78 is located on first half 66, while receiving groove 80 is located on second half 82. Protruding rim 78 and receiving groove 80 allow the device to be securely closed during washing, drying, and storage. It also prevents lateral movement of first half 66 and second half 82. This design also alleviates stress on the latching mechanism and first hinge 50 and second hinge 84 when properly used.

Figure 9:
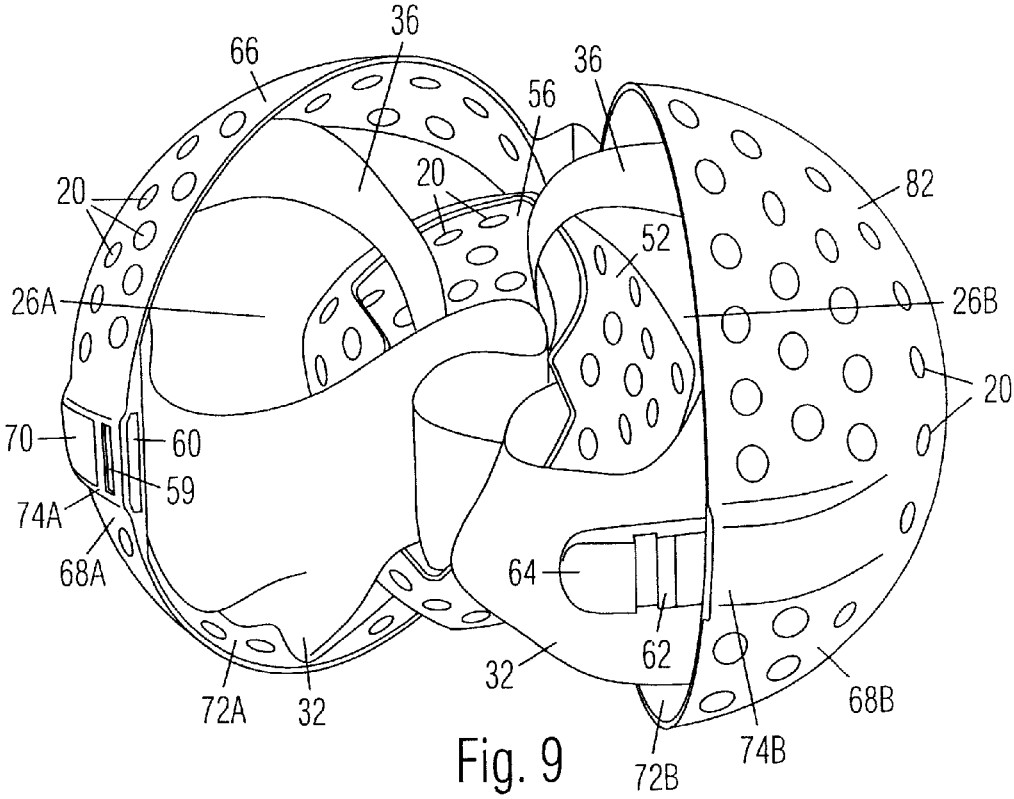
FIG. 9 shows the device's latching mechanism.

FIG. 9—Front View of Preferred Embodiment Latching Mechanism

FIG. 9 shows the latching mechanism in detail (previously described in FIGS. 1 and 6). (Most of the holes 20 on the device are shown in FIG. 9.) Tongue 64 has a ridge 62 that locks into receptacle 60 and ridge opening 59. Receptacle 60 is located between interior surface 72A and exterior surface 68A of first half 66. Ridge 62 is located midway on tongue 64, while tongue 64 is located between interior surface 72B and exterior surface 68B of second half 82. First half 66 and second half 82 shield tongue 64, ridge 62, and receptacle 60 from normal wear and tear, and ensure that the device stays closed during washing, drying, and storage. Raised exterior surface 74B on second half 82 and raised exterior surface 74A on first half 66 shields tongue 64, while also preventing the device from accidentally opening when in use.

Operation

Preferred Embodiment

FIGS. 1 to 9

When washing, drying, or storing one bra in the device, it is placed with its bra cup's front sides 28A and 28B facing outer shell interior surfaces 72A and 72B. If placing a second bra into the device, the second bra's front sides (28A and 28B) face the first bra's breast sides 26A and 26B. Next, shoulder straps 36 and back straps 32 of both the first and second bras are tucked into hollow compartment 56, as shown in FIG. 4.

A third bra can be placed within the device. The third bra's cup front sides 28A and 28B face the second bra's breast sides 26A and 26B. Next, all three bra's shoulder straps 36 and back straps 32 are tucked into hollow compartment 56.

Multiple bras can be thoroughly cleaned, dried, and stored in this manner due to the numerous number of holes 20 throughout first half 66 and second half 82, and on inner form 52 of the device. As stated, first half 66 and second half 82 have approximately 120 to 160 holes, while inner form 52 has approximately 40 to 70 holes. When two semi-padded or three non-padded bras are simultaneously washed in the device, I have found that holes 20 allow detergent, water, and air to freely penetrate and flow between the bras to thoroughly wash and dry as well as safely store each bra, including the middle placed bra when three bras are concurrently washed.

Figure 10:
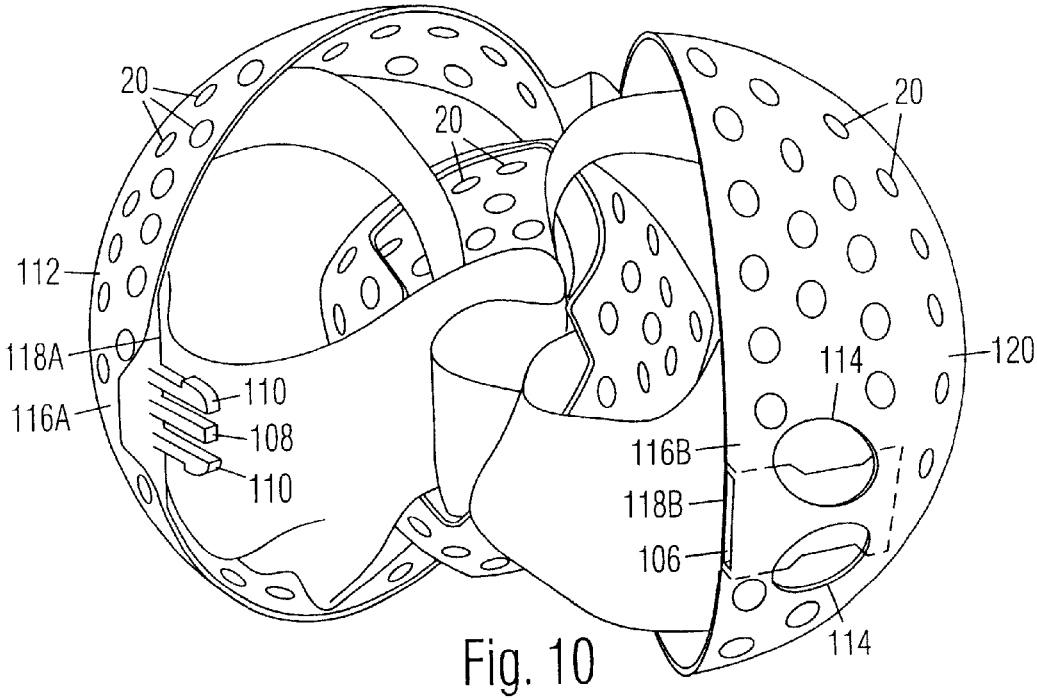
FIG. 10 shows an alternative latching mechanism.

FIG. 10—Alternative Latching Mechanism

FIG. 10 shows the preferred embodiment an alternative latching mechanism, comprising receptacle 106, teeth 110, and separator 108. (Most of the holes 20 on the device are shown in FIG. 10.) Teeth 110 are located on first half 112 while receptacle 106 is located on second half 120. Teeth 110 and separator 108 are located between the interior surface 118A and exterior surface 116A of first half 112. Receptacle 106 is located between interior surface 118B and exterior surface 116B of second half 120. This design shields teeth 110, separator 108, and receptacle 106 from normal wear and tear. The location of receptacle 106 also keeps the device securely closed during washing, drying, and storage. Teeth 110 and separator 108 are aligned with receptacle 106. A click will be heard when the device is properly closed. To open the device, the user inserts two fingers into finger openings 114, presses teeth 110 together, and then pulls first half 112 and second half 120 away from each other.

Figure 11:
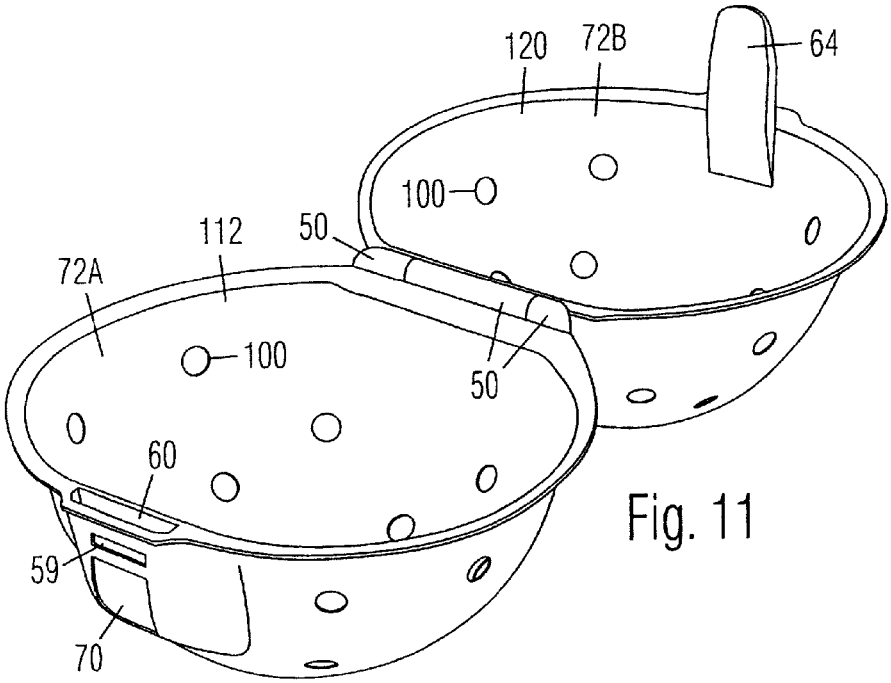
FIG. 11 shows a first alternative embodiment: a ball-shaped device without an inner form, leaving only the outer shell's two halves.

FIG. 11—First Alternative Embodiment

FIG. 11 illustrates a first alternative embodiment of the bra protector. This embodiment is designed for washing, drying, and storing prosthetic breast forms. Only one pair of prosthetic breast forms should be washed in this device. Given the thickness of each prosthetic breast form, washing, drying, or storing more than one pair of breast forms will prevent them from being thoroughly cleaned and dried. This embodiment can also be used for washing, drying, or storing removable bra straps, demi-pads, pushup pads, shoulder pads, hosiery, panties, scarves and small clothing articles.

This embodiment is essentially the same as preferred embodiment in FIG. 1, except that inner form 52 and second hinge 84 is removed. This first alternative embodiment is only comprised of outer shell, including first half 112 and second half 120. Holes 100 for the penetration of detergent, water, and air can be seen throughout the device's first half 112 and second half 120. (The number of holes 100 in FIG. 11 has been decreased for clarity purposes.) This embodiment includes the same latching mechanism comprising tongue 64 with ridge 62 (not shown) located on second half 120, and receptacle 60, ridge opening 59, and finger opening 70 located on first half 112. This embodiment includes first hinge 50 that connects first half 112 and second half 120.

To place prosthetic breast forms inside this device, bra cup front sides 28A and 28B are placed facing the device's interior surfaces 72A and 72B. The convex shape of bra cup front sides 28A and 28B should conform with the concave shape of interior surfaces 72A and 72B.

Figure 12:
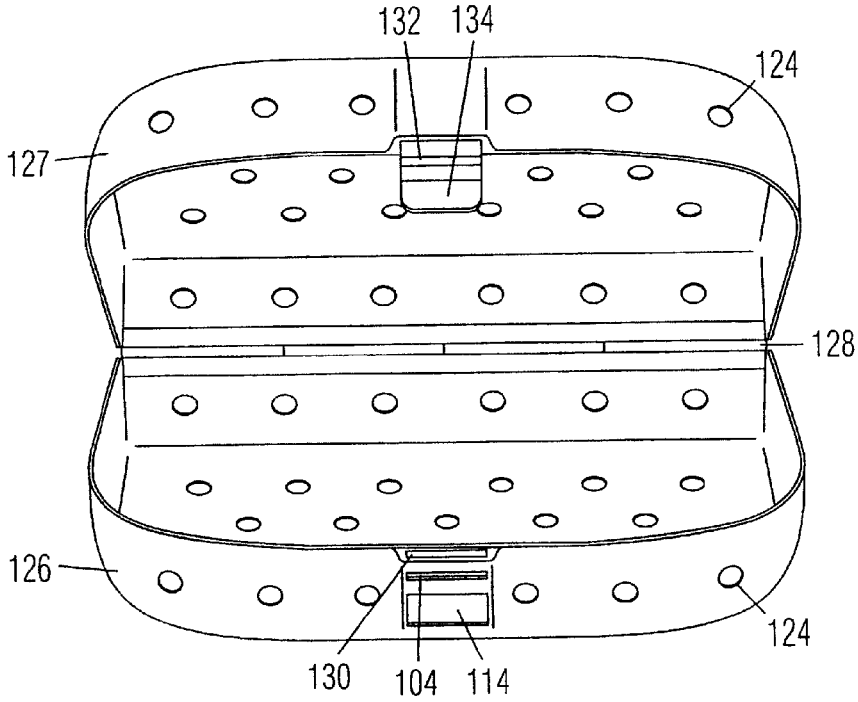
FIG. 12 shows a second alternative embodiment with a flat semi-circular shape and without an inner form.

FIG. 12—Second Alternative Embodiment

FIG. 12 illustrates a second alternative embodiment. It is much smaller in size than the embodiments of FIGS. 1 and 11. This embodiment has a flat, disk-like appearance and is ideal for non-padded underwire and non-underwire bras. The device is not recommended for semi-padded or thickly-padded bras, especially those made of soft foam, air, water, gel and silicone. It is also not recommended for bras made of extremely delicate materials, such as lace, satin, silk, mesh, high-tech microfiber, stretch and sheer fabric. However, this embodiment may be used to wash, dry, and store removable bra straps, demi-pads, pushup pads, shoulder pads, hosiery, panties, and scarves.

This embodiment has a first half 126 and a second half 127 connected to each other by a hinge 128. This device has numerous holes 124 that are large enough for water, detergent, and air to penetrate, but small enough to contain bra shoulder strap 36, back strap 32, and hooks, thus preventing them from becoming tangled with other clothing articles and the washer and dryer's crevices. (The number of holes 124 in FIG. 12 has been decreased for clarity purposes.) The device also protects bra underwires 48 from becoming bent or protruding from the bra and thus piercing its fabric.

This embodiment has the same latching mechanism as that of the previous embodiments. This includes tongue 134 with ridge 132 located on second half 127, and receptacle 130, ridge opening 104, and finger opening 114 on first half 126. Other latching mechanisms can also be used.

Before placing a non-padded bra in this device, the hooks on back strap 32 should be latched to their corresponding eyelets. Next, the bra should be folded in half with the two cup breast sides 26A and 26B facing each other. The folded bra is then placed inside the device. Shoulder straps 36 are tucked inside the device. To wash, dry, or store two or three non-padded bras, each folded bra is placed on top of the other inside the device.

One limitation of this device is that it should not be used to wash, dry, or store padded bras, especially thickly padded bras, as they need an inner form to prevent the collapse, indentation, leakage, and bunching of the bra cups.

ADVANTAGES

From the description above, a number of advantages of my bra protector become evident:

(a) It is easy to use. All components (hinges and latching mechanism) are attached to the device, thereby preventing the possibility of their misplacement. The device is designed to enable the user to place a bra inside the device easily. The inner form not only separates the left bra cup from the right bra cup, but it also offers structural support for the bra cups' breast side and houses both the bra's back and shoulder straps, thereby preventing the bra from shifting out of its preferred position as well as hooking and puncturing the bra itself. Since the inner form is shaped to the contour of a thickly padded bra, the user can use the device to wash thickly padded, semi-padded, and non-padded bras.

(b) Easy placement of bra, bikini tops, and accessories inside the device. The user is not confused in which direction to move the inner form as the second hinge only allows it to swing outward. This facilitates the loading and unloading of bra(s) and also prevents the inner form from moving away from its intended original position between the two outer shell's halves.

(c) Since it can be made of sturdy plastic, it can withstand hot water and hot dryer air and the impact received from a washing machine and a dryer.

(d) It contains all of a bra's components for machine washing, drying, and storage.

(e) It fits easily into a washing machine and dryer.

(f) It has numerous holes that are large enough for water, detergent and air to penetrate, yet are smaller than the bra's straps to prevent them and its hooks from escaping the device.

(g) It is very versatile; it can be used to wash various kinds of bras-including heavily padded, semi-padded, and non-padded bras, regardless of whether the padding is made of soft foam, air, water, gel, or silicone.

(h) It can accommodate a maximum capacity of three bras. It can hold one thickly padded bra, two semi-padded, or three non-padded bras. Given that a thickly padded bra is 0.51 to 2.50 cm in thickness, only one bra should be placed inside one device for thorough washing and drying. However, two semi-padded bras, with a bra cup thickness of 0.26 to 0.50 cm can be concurrently placed in one device for thorough washing and drying. Thus, three non-padded bras with a bra cup thickness of 0.05 to 0.25 cm can be concurrently placed in one device for thorough washing and drying.

(i) It preserves the curvature of the bra's cups during washing, drying and storage. The outer shell's two halves and inner form accomplish this as they are designed according to the contours of the bra cup front sides and cup breast sides respectively.

(j) It provides protection for the bra's underwires by preserving their shape and preventing them from moving around within the device, and thus becoming misshapen or piercing of the bra's fabric and other materials. This ensures proper fitting of the bra around the wearer's breasts after machine washing and drying and prevents the discomfort caused by a protruding underwire.

(k) It has a separate housing compartment for bra shoulder and back straps and its hooks in order to prevent them from puncturing and tearing other clothing articles as well as the bra itself. The hollow compartment of the inner form also preserves the straps' elasticity by protecting them from mechanical stress incurred from machine washing and drying.

(l) It has an outer shell that can be split into its two halves to protect the bra's delicate fabric, thus preventing it from running, snagging, and puckering. This is especially important in preserving extra delicate bras made of lace, satin, silk, high-tech microfiber, sheer, stretch, and mesh fabric.

(m) It has a reliable and user-friendly latching mechanism that is located between the protruding exterior and interior surfaces of the outer shell and is not susceptible to damage when properly used.

(n) It has a protective outer shell that shields both the latching mechanism and the bra contained inside it during washing, drying, and storage.

(o) It can be used to wash, dry, and store not only bras and bikini tops, but also removable bra straps, demi-pads, pushup pads, shoulder pads, hosiery, panties, and scarves.

(p) It has no sharp edges, and thus it will not damage other clothing articles in the washer or dryer while in use.

(q) It is securely closed during washing, drying, and storage by having a protruding rim on the outer shell's first half, which fits tightly into a receiving groove in the outer shell's second half. This design prevents lateral movement of the two halves and alleviates stress on the latching mechanism and its hinges (first hinge and second hinge) when properly used. It also adds extra protection and reinforcement for the outer shell's two halves to remain securely closed.

RAMIFICATIONS AND SCOPE

While the above description contains many specificities, these should not be construed as limitations on the scope of the invention, but rather as an exemplification of my preferred embodiment and some of the other presented preferred embodiments. Many other variations are possible. For example, the bra protector can have other shapes, such as oval, elliptical, semi-circular shape, etc., and will come in many different bra sizes, colors, materials, and dimensions. The first alternative preferred embodiment can also include a divider within the device to separate objects placed in the two outer shell halves. The air/water/detergent holes can vary in number and shape. E.g., the holes can be oval, square, triangular, rectangular, crescent shaped, etc., or even mixed. The hinges can be living hinges. The protector can alternatively be made of metal, wood, resin impregnated cloth, etc. Thus the scope of the invention should be determined by the appended claims and their legal equivalents, rather than by the examples given.

I claim:

1. A device for washing, drying, and storing brassiere, comprising:

a. a body having a sufficient size to accommodate a brassiere-like object having a cup or inner side and an outer side, b. said body biaxially hinged to the shell connecting hinge round shape with a plurality of holes, c. said body comprising an outer shell in two parts hingedly connected and a hollow interior, d. an inner form having
   i. a hollow interior;
   ii. a plurality of holes, and
   iii. a curved contour similar to that of said brassiere-like object's breast side, e. said inner form being positioned within said hollow interior of said outer shell.

2. The device of claim 1 wherein the inner form is hollow together.

3. The device of claim 1, further including a releasable latch for releasably holding said two parts of said outer shell together.

4. The device of claim 1 wherein said inner form contains a plurality of holes.

5. The device of claims wherein said outer shell and inner form are made of moldable material.

6. The device of claim 3, hinge holding said shell together has a first pin, said biaxial hinge sharing said pin.

7. The device of claim 1, further including a releasable latch for releasably holding said two parts of said outer shell together, said latch comprising a protruding tongue and receptacle, said receptacle attached to first part of outer shell, said tongue attached to second part of outer shell.

8. The device of claim 1, further including a releasable latch for releasably holding said two parts of said outer shell together, said latch comprising a plurality of teeth, a separator, and a receptacle, said teeth and said separator being attached to said first part of said outer shell, said receptacle being attached to said second part of outer shell.

9. The device of claim 1 wherein said device is made of moldable material, comprises two parts which are hinged together, and further includes a releasable latch for releasably holding said two parts of said outer shell together, and wherein said latch comprises a protruding tongue and receptacle, said receptacle being attached to first part of outer shell, said tongue being attached to said second part of outer shell.

10. A device for protecting a garment having a brassiere configuration which has a pair of cups, during washing, drying, and storing, comprising:

a. a foraminous outer shell for holding said brassiere, said outer shell being openable for insertion of said bra and closable for holding said brassiere during washing, and b. a unitary foraminous inner form which can fit within said outer shell and which has two outer surfaces configured for mating with said brassiere cups and for holding their shape.

11. The device of claim 10 wherein said outer shell comprises two halves which are hinged together.

12. The device of claim 11, further including a releasable latch for releasably holding said two halves together.

13. The device of claim 10 wherein said inner form is hinged to said outer shell.

14. The device of claim 10 wherein said inner form is attached to said outer shell.

15. The device of claim 10 wherein said outer shell and inner form are made of moldable material.

16. The device of claim 10 wherein said outer shell is formed of two halves which are hinged together by a hinge having a first pin, said hinge having one knuckle which has a projecting extension, said inner form being hinged to said projecting extension with a hinge having a second pin which is perpendicular to said first pin.

17. The device of claim 16, further including a releasable latch for releasably holding said two halves together and wherein said outer shell is formed of two halves which are hinged together by a hinge having a first pin, said hinge having one knuckle which has a projecting extension, said inner form being hinged to said projecting extension with a hinge having a second pin which is perpendicular to said first pin.

18. The device of claim 10, further including a releasable latch for releasably holding said two halves together, said latch comprising a protruding tongue and receptacle, said receptacle attached to first half of outer shell, said tongue attached to second half of outer shell.

19. The device of claim 10, further including a releasable latch for releasably holding said two halves together, said latch comprising teeth, a separator, and a receptacle, said teeth and said separator being attached to said first half of said outer shell, said receptacle being attached to second half of outer shell.

20. The device of claim 10 wherein said device is made of moldable material, comprises two halves which are hinged together, and further including a releasable latch for releasably holding said two halves together, and wherein said latch comprises a protruding tongue and receptacle, said receptacle being attached to first half of outer shell, said tongue being attached to second half of outer shell.

* * * * *